US005687644A

United States Patent [19]

Rann et al.

[11] Patent Number: 5,687,644

[45] Date of Patent: Nov. 18, 1997

[54] APPARATUS FOR EXPELLING AIR FROM STACKS OF SUPERIMPOSED SHEETS

[75] Inventors: Harald Rann; Norbert Rilitz; Holger Schauer, all of Hamburg, Germany

[73] Assignee: E.C.H. Will GmbH, Hamburg, Germany

[21] Appl. No.: 663,352

[22] Filed: Jun. 13, 1996

[30] Foreign Application Priority Data

Jun. 29, 1995 [DE] Germany ..... 195 23 699.8

[51] Int. Cl.[6] ..... B30B 9/00

[52] U.S. Cl. ..... 100/90; 100/156; 414/790.2; 414/907

[58] Field of Search ..... 100/90, 156, 210; 414/790.2, 907

[56] References Cited

U.S. PATENT DOCUMENTS

| | | | |
|---|---|---|---|
| 730,368 | 6/1903 | Hampp | 100/210 |
| 4,313,703 | 2/1982 | Fabrig | 414/907 |
| 4,509,417 | 4/1985 | Brandt et al. . | |
| 4,765,791 | 8/1988 | Brandt et al. | 100/156 |
| 4,836,074 | 6/1989 | Mohr | 100/90 |
| 4,984,516 | 1/1991 | Scalzitti et al. | 100/90 |
| 5,150,647 | 9/1992 | Mohr | 100/90 |
| 5,233,815 | 8/1993 | Kröger et al. . | |

FOREIGN PATENT DOCUMENTS

| | | | |
|---|---|---|---|
| 27 23 162 | 11/1978 | Germany . | |
| 27 53 668 | 6/1979 | Germany . | |
| 3403209 | 8/1984 | Germany . | |
| 90 04 711.7 | 6/1990 | Germany . | |
| 41 16 969 | 11/1992 | Germany . | |
| 64-81730 | 3/1989 | Japan | 414/790.2 |

*Primary Examiner*—Stephen F. Gerrity
*Attorney, Agent, or Firm*—Darby & Darby

[57] ABSTRACT

Apparatus for expelling air from between the sheets of stacks of superimposed sheets has a conveyor which advances successive stacks of a series of stacks along a horizontal first path from a stack assembling first station toward a second station. The conveyor employs a reciprocable carriage for one or more tongs which engage the front end portion of fresh stack at the first station and entrain the stack toward the second station. A roller is mounted in a conveyance for repeated movement with the conveyance along a downwardly sloping second path from a raised position above and away from the first path to a lowered position of engagement with successive stacks which are being advanced toward the second station. The conveyance is provided with a follower which tracks a vertical guide on the carriage to ensure that the roller moves vertically downwardly into engagement with a freshly gathered stack immediately behind the tongs irrespective of the height of the sack to thus ensure at least substantially complete expulsion of entrapped air (if any) when the conveyance is arrested as soon as the roller engages an advancing stack but the thus engaged stack continues to advance toward its second position.

20 Claims, 3 Drawing Sheets

APPARATUS FOR EXPELLING AIR FROM STACKS OF SUPERIMPOSED SHEETS

BACKGROUND OF THE INVENTION

The invention relates to improvements in apparatus for expelling air from stacks or piles of overlapping (particularly superimposed) sheets of paper or the like. More particularly, the invention relates to improvements in apparatus wherein the stacks or piles (hereinafter referred to as stacks) of superimposed sheets are pulled along a track from a first or starting position to a second or advanced position, and an air expelling device is caused to descend onto and to bear against the uppermost or topmost sheet of the stack while the latter is on its way from the starting to the advanced position, i.e., while the stack moves relative to the air expelling device.

Pockets of air which are entrapped between the sheets of a stack are likely to interfere with further processing of the stack for a number of reasons. This holds true regardless of the exact nature of the sheets in the stacks, i.e., the sheets can be made of paper or of any one of a variety of other materials, e.g., synthetic plastic materials or laminates containing two or more coherent sheets or films made of the same material or of different materials. Pockets of entrapped air can develop between neighboring individual sheets or between neighboring groups containing identical or different numbers of superimposed sheets.

One of the reasons why one or more pockets of entrapped air (this term is intended to embrace air and/or other gaseous fluids) are likely to adversely affect the manipulation of stacks is that such pockets affect the stability of the stacks, i.e., of accumulations of commodities which are rather unstable to start with. Thus, the sheets which flank a body of entrapped air are more likely to slide relative to each other and to thus cause the stack to change its configuration in a manner which can create serious problems during further processing, e.g,, during introduction into a box or another suitable receptacle. For example, a ream of paper sheets should constitute a brick-shaped body at least immediately prior to and during insertion into a box or prior to draping into a sheet of wrapping material.

Air which happens to become entrapped between the sheets of a stack is likely to escape (and more particularly to become expelled in response to the weight of the sheets thereabove) within a certain interval of time. However, such intervals are much too long in many stack assembling and processing plants wherein the stacks must be assembled and processed (e.g., packed) within extremely short intervals of time. For example, the interval which elapses between the accumulation of sheets into a ream and the confinement of such ream in a box or in a sheet of wrapping material is much too short to permit automatic or unassisted expulsion of entrapped air. In addition, the distances to be covered by a stack from the locus of assembly of sheets into the stack and the following processing station are frequently short or extremely short; this, too, renders it unlikely that the entrapped air would escape (or become expelled) without resorting to an air expelling system.

One of the presently known proposals to expel entrapped air from stacks of superimposed sheets is disclosed in published German patent application No. 27 53 668. This publication describes an apparatus wherein a stack is pulled from a starting position to a further position by at least one set of tongs relative to a vertically movable roller which bears upon the uppermost sheet of the advancing stack to thus squeeze the body or bodies (if any) of entrapped air from the moving stack. A drawback of such apparatus is that it does not contain any means for reliably preventing collisions between the descending roller and the forwardly moving tongs. Furthermore, the apparatus which is described in the published German patent application lacks any means for ensuring that the descending roller comes into contact with the advancing stack immediately behind the tongs, i.e., such apparatus cannot ensure reliable expulsion of any and all entrapped air while the stack moves relative to and is being acted upon by the lowered roller.

Another apparatus, described in German patent No. 34 03 209 A1, employs a brush, in lieu of a roller, as a means for expelling air from an advancing stack of superimposed sheets. The brush is carried by pivotable levers which are installed at the sides of the path for successive advancing sheets and thus contribute significantly to the width of the air expelling apparatus. Moreover, the patented apparatus is not provided with any means for properly controlling the inclination of the brush relative to the upper side of the topmost sheet of an advancing stack beneath the brush and/or with any means for controlling the exact locus of initial contact between the brush and the topmost sheet of the stack which is being advanced beneath the brush. Therefore, the air expelling action of the patented apparatus is not sufficiently reliable and/or uniform.

OBJECTS OF THE INVENTION

An object of the invention is to provide an apparatus which is constructed and assembled to expel air from stacks of superimposed sheets and the air expelling action of which is more reliable than that of heretofore known apparatus.

Another object of the invention is to provide an apparatus which constitutes an improvement over and further development of apparatus disclosed in the published German patent application No. 27 53 668 and/or in German patent No. 34 03 209 A1.

A further object of the invention is to provide an apparatus wherein the means for effecting a relative movement between stacks of superimposed sheets and the air expelling unit of the apparatus cooperate with each other in a novel and improved way.

A further object of the invention is to provide the apparatus with novel and improved means for initiating and controlling the movements of the air expelling unit relative to and/or with the means for effecting relative movements between the air expelling unit and a stack.

An additional object of the invention is to provide a simple and compact air expelling apparatus which can be utilized in conjunction with or in modern high-speed stack assembling and/or processing machines.

Still another object of the invention is to provide an apparatus which does not contribute to a significant increase of the width of the machine or production line in which the apparatus is being put to use.

A further object of the invention is to provide an apparatus wherein the air expelling unit cannot collide and/or otherwise adversely affect the operation of the means for effecting relative movements between a stack and the air expelling unit.

Another object of the invention is to provide an apparatus which is capable of expelling, with the same degree of reliability, entrapped air from tall or thin, wide or narrow and/or long or short stacks of superimposed sheets of paper and/or other sheet material.

An additional object of the invention is to provide a novel and improved method of relating the movements of the air expelling unit to the movements of the stacks which are to be treated by such unit.

Still another object of the invention is to provide a readily adjustable air expelling apparatus.

A further object of the invention is to provide a novel and improved track for advancing stacks which can be put to use in the above outlined apparatus.

Another object of the invention is to provide an air expelling apparatus which can be put to use in existing machines and production lines for the assembly and/or processing of stacks of superimposed sheets of paper and/or other material.

SUMMARY OF THE INVENTION

The invention is embodied in an apparatus for expelling air which is entrapped between the sheets of stacks of sheets including a topmost sheet and a lowermost or bottom sheet. The improved apparatus comprises means (e.g., a substantially horizontal track) defining a first predetermined path for the advancement of successive stacks of a series of stacks from a first position (for example at a stack forming or assembling station) to a second position (e.g., at or close to a packing or other stack processing station) in such a way that a stack advancing along the first path has a front portion (such as a transversely extending edge portion). The improved apparatus further comprises means for advancing successive stacks of the series along the first path including means for engaging the front portions of the stacks in the first positions of the stacks, and means for expelling entrapped air from the advancing stacks. The expelling means comprises at least one air expelling device (such as an idler roller, e.g., in the form of an elongated cylinder extending transversely of the direction of advancement of stacks along the first path) which is movable downwardly into pressure-exerting or pressure-applying engagement with the topmost sheet of a stack advancing along the first path, and means for confining the at least one device to downward movements along a predetermined second path. The confining means comprises at least one guide provided on the advancing means.

The advancing means for the stacks preferably further comprises a carriage which is reciprocable along the first path, and the means for engaging can include one or more tongs provided on and sharing the reciprocatory movements of the carriage along the first path.

The at least one guide is or can be provided on the carriage of the advancing means.

The means for expelling air can further comprise a conveyance (e.g., a slide) for the at least one air expelling device. The conveyance is preferably reciprocable with the at least one device along the second path, and the confining means of the means for expelling air can further include means for restricting the conveyance to movements along the second path. Still further, the confining means comprises at least one follower provided on the conveyance and serving to track the at least one guide, at least during downward movement of the at least one device toward pressure-exerting engagement with the topmost sheet of a stack advancing along the first path.

The first and second paths preferably make an oblique angle, e.g., an acute angle of or close to 45°.

The at least one guide and the aforementioned restricting means are preferably constructed and assembled to effect the engagement of the at least one device with the topmost sheet of a stack having a predetermined height (as measured transversely of the first path) in a predetermined intermediate position of the stack between its first and second positions.

Regardless of whether the means for engaging includes tongs or other suitable means for grasping and entraining the front portion of a stack from the first position, the means for confining is preferably operative to effect a start of pressure-exerting engagement of the at least one device with the topmost sheet of the stack advancing from its first position immediately adjacent and behind the stack engaging means, as seen in the direction of advancement of stacks from their first positions.

The first path can be a substantially horizontal path, e.g., a straight horizontal path, and the second path can be a straight path or a path which departs from a straight path.

The at least one guide can be designed to define a substantially vertical track (i.e., a third path), and the aforementioned conveyance of the means for expelling air can be a reciprocable slide which is mounted for movement with the at least one device along the second path and carries the aforementioned follower of the confining means. The follower moves downwardly along the substantially vertical track during downward movement of the at least one device toward pressure-exerting engagement with the topmost sheet of a stack advancing from its first position. The at least one guide can be provided with at least one first substantially vertical surface which defines the track, and the at least one follower can be provided with a second substantially vertical surface which engages the first surface during downward movement of the at least one device.

The air expelling means preferably further comprises means for repeatedly moving the conveyance along the second path, first in a downward direction to move the at least one device into engagement with the topmost sheet of a stack leaving its first position, to thereupon maintain the at least one device in pressure-exerting engagement with the topmost sheet of the stack which continues to advance toward its second position, and to thereupon raise the at least one device above and away from the first path, namely above and away from the level of the topmost sheet of the stack which has reached or is still in the process of advancing toward its second position but has been relieved of entrapped air. In other words, the means for moving can be said to include means for reciprocating the conveyance with the at least one follower and with the at least one device along the second path downwardly toward and upwardly away from the first path.

The means which defines the first path can include one or more abutments for the lowermost sheet of the stack advancing along the first path, at least while the topmost sheet of the advancing stack is being engaged by the at least one device. The abutment or abutments can include one or more platforms beneath the first path.

The air expelling means of the improved apparatus can further comprise means for adjustably mounting the at least one device on the mobile conveyance, Such means for adjustably mounting can include means for positioning the at least one device at any one of a plurality of different levels. If the apparatus is designed to expel air from different types of stacks, particularly from stacks having different heights, each of the aforementioned different levels for the at least one device relative to its conveyance can be selected in a manner to ensure that the at least one device is maintained in a predetermined (particularly unchanging) pressure-exerting engagement with a stack having one of a plurality of different heights. In other words, the adjustability of the at least one device with reference to its conveyance can be selected in such a way that the force with which the at least one device bears upon the topmost sheet of a stack is the same irrespective of whether the stack is a tall stack or a relatively thin stack.

As already mentioned above, the means for confining can further comprise one or more second guides which restrict the conveyance to reciprocatory movements along the second path. The means for reciprocating the conveyance relative to the at least one second guide can include one or more fluid-operated motors. For example, each motor can comprise a pneumatic cylinder which is slidable along the at least one second guide, and such pneumatic cylinder can be fixedly secured to or can form part of the conveyance.

The novel features which are considered as characteristic of the invention are set forth in particular in the appended claims. The improved air expelling apparatus itself, however, both as to its construction and the mode of installing and operating the same, together with numerous additional features and advantages thereof, will be best understood upon perusal of the following detailed description of certain presently preferred specific embodiments with reference to the accompanying drawings.

DESCRIPTION OF PREFERRED EMBODIMENTS

Figure 1:
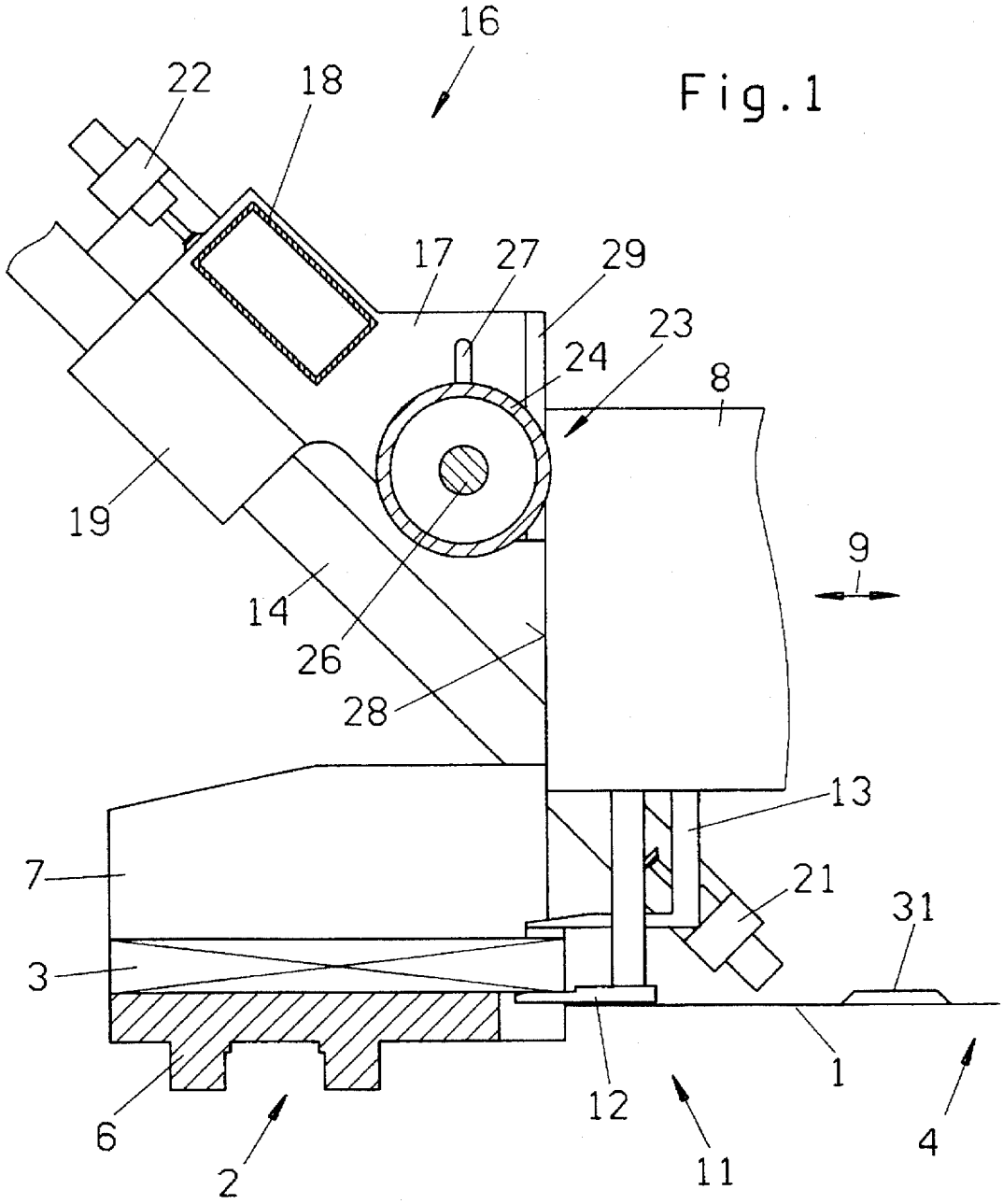
FIG. 1 is a fragmentary partly side elevational and partly vertical sectional view of an apparatus which embodies one form of the invention, a stack of superimposed sheets being shown in a starting position and the air expelling unit being shown in a raised or retracted position above and away from the topmost sheet of the stack.

Referring first to FIG. 1, there is shown a portion of an apparatus which is designed to expel air from pockets between the sheets of a series of successive stacks 3. The apparatus comprises an arrangement 1 which defines a straight horizontal or substantially horizontal first path for the advancement of successive stacks 3 of the series from a first or starting position shown in FIG. 1 (as at 2), through an intermediate position shown in FIGS. 1 and 2 (as at 4), and to (or beyond) a second or advanced position shown in FIG. 3. The first position 2 can be defined by a substantially box-shaped receptacle 6 having sidewalls 7 (only one can be seen in the drawings) which flank successive stacks 3 prior to entrainment of such stacks in a direction to the right from the first positions 2, through the intermediate positions 4, and to (and if necessary beyond) the second positions. The receptacle 6 can receive fully assembled stacks 3, or it can serve as a means for receiving discrete sheets (e.g., paper sheets) or groups of sheets which are gathered into successive stacks 3 in the space between the sidewalls 7.

A stack 3 which has completed its advancement along the horizontal path defined by the arrangement 1 from the first position 2 in the receptacle 6 to the second position can be accepted by a suitable conveyor (not specifically shown) which serves to transport successive stacks to a processing station, e.g., into a packing or wrapping machine (not shown) wherein the stacks are introduced into boxes or are draped into sheets of suitable wrapping material. For example, each stack 3 can constitute a ream of 500 panels or sheets of paper or any other suitable sheet material.

The means for advancing successive stacks 3 from the receptacle 6 to the respective second positions includes a carriage 8 which is reciprocable (note the double-headed arrow 9 in FIG. 1 ) along the horizontal path defined by the arrangement 1 in any well known manner not forming part of the present invention. The stack advancing means further comprises means 11 for engaging the front (right-hand) end portions of successive stacks 3 in the receptacle 6 and for pulling the stacks out of the space between the sidewalls 7, through the intermediate positions 4, and at least to the second positions (see FIG. 3). The illustrated engaging means 11 includes tongs having an upper gripper or jaw 13 serving to engage the front portion of the topmost sheet of the stack 3 in the receptacle 6 and a lower gripper or jaw 12 which serves to engage the front portion of the lowermost sheet or bottom sheet of such stack. The advancing means for successive stacks 3 of the series can include two or more engaging means 11 each of which has one or more tongs with jaws 12, 13 or analogous stack gripping and entraining means.

All necessary details of means for advancing successive stacks of a series of stacks along a predetermined path between a first station or position and a second station or position are described, for example, in German patent No. 41 16 969 A1 and in the corresponding U.S. Pat. No. 5,233,815. The disclosure of the U.S. patent is incorporated herein by reference. The U.S. patent describes an apparatus wherein two or more stacks, which together form a row of aligned stacks, can be advanced by engaging means including one or more tongs for each stack of the row. The tongs including the grippers 12, 13 shown in the drawings can constitute one of several tongs for the stack 3 in the receptacle 6, or one of several tongs, one or more for each of a row of two or more stacks 3 to be drawn from discrete receptacles 6 including the receptacle actually shown in the drawings and one or more receptacles behind the illustrated receptacle.

In accordance with a feature of the invention, that end portion of the carriage 8 for the tongs including the grippers 12, 13 which confronts the receptacle 6 supports or constitutes a first guide 28 having a substantially vertical surface defining a track or path for the complementary vertical surface of a follower 29 on a conveyance forming part of a unit 16 which serves to expel entrapped air from between the sheets of a stack 3 which is in the process of being advanced from the first position 2 in the receptacle 6 toward the second position. The unit 16 further comprises a device 23 which serves to actually expel air from successive stacks 3 upon completion of a downward movement from the upper end position shown in FIG. 1 to the lower end position shown in FIGS. 2 and 3, and a device which serves to confine the device 23 to movements along a predetermined second path which is determined in part by the guide 28. The confining device includes the follower 29, the guide 28 and one or more elongated cylindrical, tubular or polygonal second guides 14 carried by the frame (not specifically shown) of the improved air expelling apparatus. The illustrated apparatus comprises two second guides 14, one at each side of the first path (for the stacks 3) and establishing for the conveyance of the unit 16 an elongated straight second path which makes with the first path an oblique angle. As shown in the drawings, the two paths can make an acute angle of or close to 45°.

The conveyance for the air expelling device 23 includes two substantially plate-like upright sidewalls 17 (only one can be seen in the drawings) which are connected to each other by a transversely extending crosshead 18. The sidewalls 17 flank the path for the stacks 3, and each of these sidewalls is of one piece with a discrete pneumatic cylinder 19 which is slidable along the respective second guide 14. The cylinders 19 form part of fluid-operated motors which can reciprocate the conveyance, the device 23 and the follower 29 along the second path, first downwardly from the retracted upper positions shown in FIG. 1 (in which the horizontal idler roller 24 of the device 23 is located at a distance above and away from the stack 3 in the receptacle 6) to the lower end positions in which the roller 24 exerts pressure against the upper side of the topmost sheet of the stack 3 advancing from the receptacle 6 toward its second position (see FIG. 2). The motors thereupon maintain the conveyance in the lower end position for a given interval of time which is required to complete the advancement of the topmost sheet of a stack 3 past the roller 24 (FIG. 3 shows the roller 24 in engagement with the trailing end of the topmost sheet below it), and thereupon again upwardly from the lower end position of the conveyance shown in FIG. 3 back to the upper end position shown in FIG. 1. The motors can be said to constitute double-acting pneumatic cylinder units which ensure that the conveyance, the follower 29 of the conveyance, and the roller 24 remain in desired positions along the second path during advancement of successive stacks 3 along the first path.

The extent of upward movement of the conveyance including the sidewalls 17 and the crosshead 18 along the guides 14 is limited by first stops 22 (only one shown) which can constitute dampers or shock absorbers and arrest the respective sidewalls 17 during movement upwardly and away from the path for the stacks 3. Analogous stops 21 (only one shown) are provided to limit the extent of downward movement of the conveyance and the roller 24 toward the path for the stacks 3.

The roller 24 constitutes but one of a variety of elements which can be used in or which can constitute the stack engaging device 23 in the apparatus of the present invention. For example, such roller can be replaced by or used in conjunction with one or more additional rollers or with one or more brushes (not shown). An idler roller 24 is preferred at this time because it can be rotated as a result of air-expelling engagement with the upper side of the topmost sheet forming part of an advancing stack 3. The end portions of a shaft 26 forming part of the roller 24 are journalled in the respective sidewalls 17 of the conveyance. Such end portions of the shaft 26 and the adjacent portions of the sidewalls 17 can be said to constitute means for adjustably mounting the roller 24 in the conveyance in such a way that the roller can be moved relative to the sidewalls 17 to any one of a plurality of different levels, depending on the height or thickness of the stacks 3 which are being gathered in the receptacle 6 and are being advanced from the receptacle toward the aforementioned conveyor or directly to a processing station. The drawings show a vertical slot 27 which is provided in the illustrated sidewall 17 (a similar slot is provided in the other sidewall 17) wherein the respective end portion of the shaft 26 can be lifted or lowered to a desired level prior to being affixed to the respective sidewall 17. The adjusting means can further include wing nuts or any other suitable fasteners which can hold the end portions of the shaft 26 at a selected level above the path for the stacks 3. The roller 24 extends transversely across and above the path for the stacks 3.

The vertical surface of the follower 29 cooperates with (i.e., it slides along) the vertical surface of the guide 28 on the carriage 8 during downward movement of the roller 24 toward air expelling engagement with the topmost sheet of a stack 3 which is in the process of being advanced from the receptacle 6. The positions of the follower 29 and guide 28 relative to each other (and the angles between the longitudinal axes of the guides 14 and the first path) are selected in such a way that, when the roller 24 reaches the advancing stack 3, it engages the topmost sheet of the stack immediately behind the upper gripper 13 of the tongs forming part of the stack engaging and entraining means 11. This greatly enhances the likelihood that all of the air which is entrapped between the sheets of the stack 3 advancing with the grippers 12, 13 is reliably expelled not later than when the trailing end of the topmost sheet advances beyond the roller 24, i.e., to the right and beyond the position shown in FIG. 3.

Figure 2:
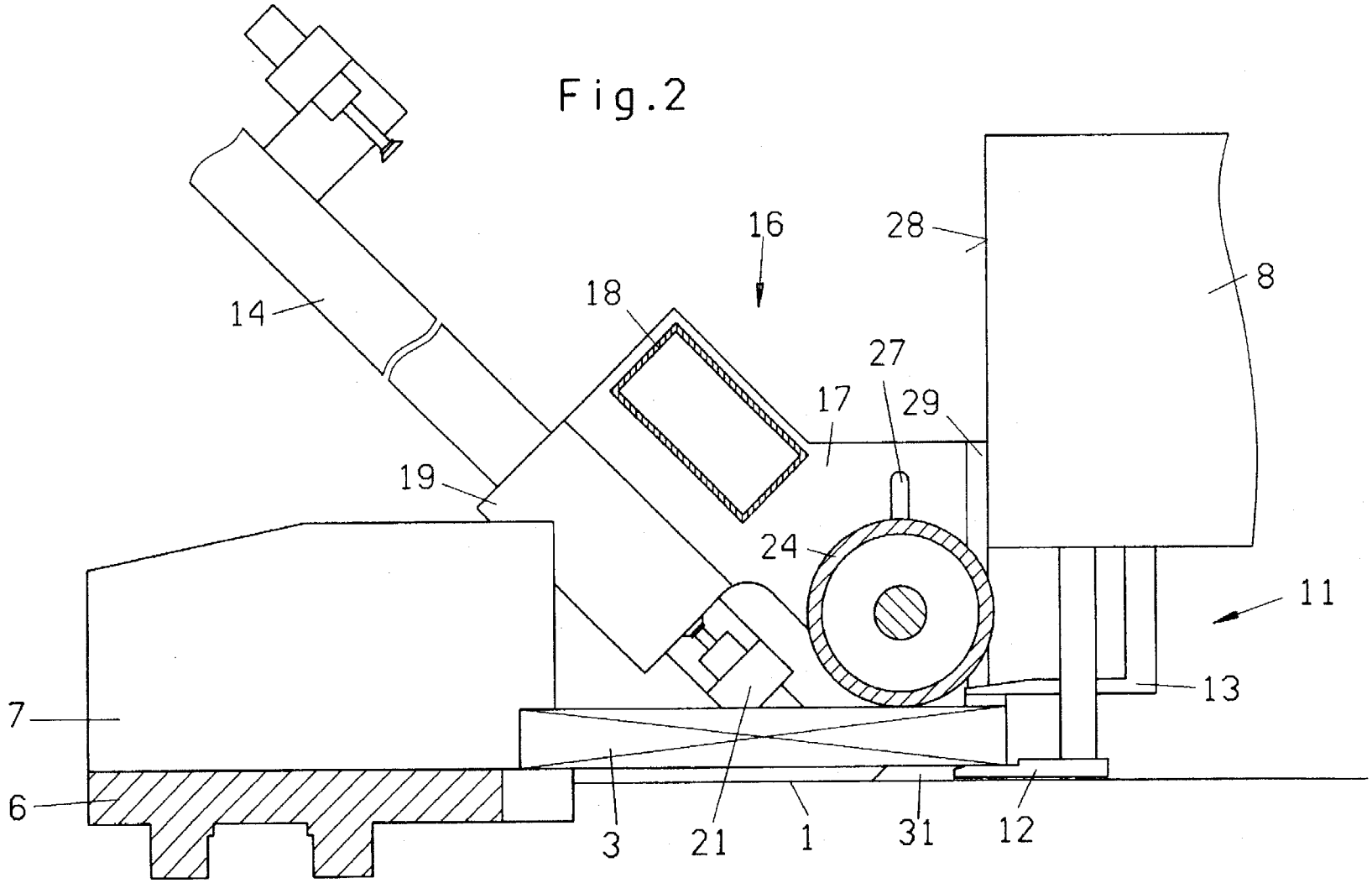
FIG. 2 shows the structure of FIG. 1 but with the stack on its way toward an advanced position and a roller of the air expelling unit in a position immediately upon descent into contact with the topmost sheet of the advancing stack.
Figure 3:
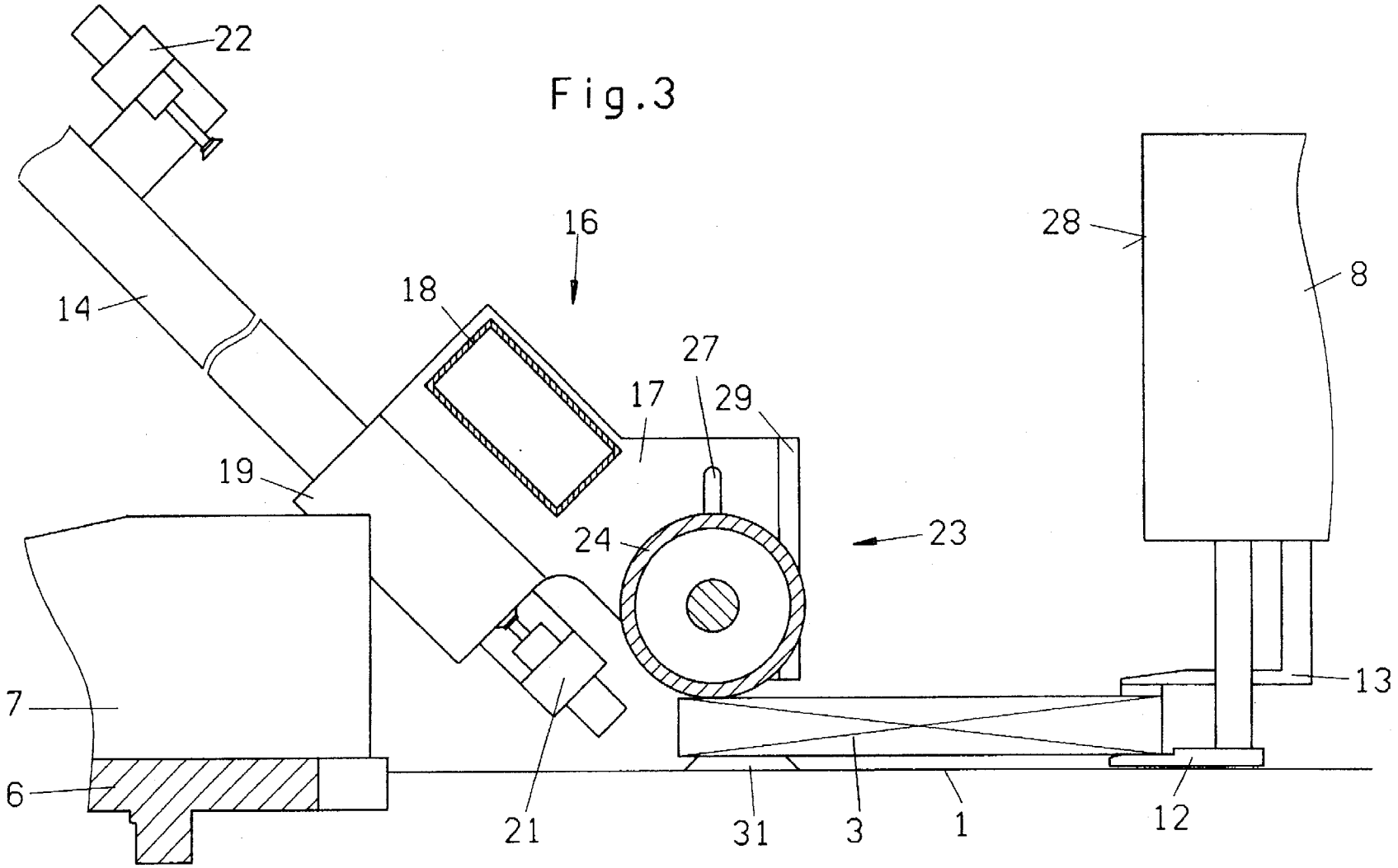
FIG. 3 shows the structure of FIG. 1 or 2 during the last stage of expulsion of air from a stack which has reached or is still in the process of moving toward the advanced position.

Fluid-operated motors utilizing cylinders corresponding to the cylinder 19 shown in each of FIGS. 1, 2 and 3 can be of the type known as Series P 230 distributed by the Firm Origa GmbH Pneumatik, Industriestrasse 8, D-70794 Filderstadt, Federal Republic Germany. Other types of motors for the conveyance mounting the roller 24 can be utilized with equal or similar advantage.

The operation of the apparatus which is shown in FIGS. 1 to 3 is as follows:

The receptacle 6 accumulates a series of successive discrete stacks 3 from a file of successively delivered discrete sheets of paper or the like, or from a series of successively delivered discrete smaller accumulations of overlapping sheets. For example, each complete stack 3 can constitute a ream containing (exactly or approximately) 500 accurately superimposed sheets. However, and as already mentioned above, the receptacle 6 can also serve to accumulate a succession of stacks each consisting of superimposed laminates, films or panels made of a suitable synthetic plastic material and/or others.

As a rule, the assembly of stacks 3 in the receptacle 6 will entail the entrapment of certain quantities of air between certain pairs of neighboring sheets in a stack. The entrapped air reduces the stability of the stacks, i.e., a stack containing pockets of entrapped air is more likely to become deformed on its way from the receptacle 6 toward and beyond the position of FIG. 3, and this can present problems during further transport, during wrapping, boxing an/or any other further manipulation and/or treatment of the stack. Thus, the improved apparatus performs a highly important function because it greatly reduces the likelihood of clogging of the path for the stacks due to distortion of air-confining stacks with attendant lengthy interruptions of the assembling and transporting of stacks, the likelihood of malfunctions at the packing station, the likelihood of unsatisfactory transfer of stacks onto a conveyor and/or other inconveniences. In many instances, the illustrated air expelling apparatus is one of a battery of two or more apparatus each of which is adjacent the path of successive stacks of series of stacks assembled in and advanced from a plurality of discrete receptacles 6 or from other suitable sources.

The grippers 12, 13 of the tongs forming part of the illustrated engaging means 11 are caused to clamp between them the front end portion of a freshly assembled stack 3 in the receptacle 6. FIG. 1 shows the grippers or jaws 12, 13 in actual engagement with the front end portion of the freshly assembled or completed stack 3 in the receptacle 6. The conveyance for the roller 24 and the follower 29 is maintained in its upper (retracted or lifted) end position in which the follower 29 abuts an upper portion of the vertical surface defined by the guide 28 of the carriage 8. The motor or another suitable prime mover for the carriage 8 is then caused to move the carriage in a direction to the right (as viewed in FIG. 1) so that the grippers 12, 13 entrain the carriage 8 toward the position shown in FIG. 2. At the same time, the pneumatic motors 19 cause the conveyance for the roller 24 to move downwardly along the stationary guide 14 so that the follower remains in contact with and simultaneously slides downwardly along the vertical surface of the guide 28 which latter shares the movement of the carriage 8. This entails an automatic downward movement of the roller 24 toward and ultimately into contact with the upper side of the topmost sheet of the stack 3 which is being entrained by the grippers 12, 13. As already mentioned hereinbefore, the inclination of the guides 14, the initial positions of the guide 28 and follower 29 relative to each other, and the level of the roller 24 relative to the sidewalls 17 of the conveyance including the sidewalls 17 and the crosshead 18 are selected in such a way that the peripheral surface of the roller 24 engages the topmost sheet of the advancing stack 3 immediately or at least closely behind the gripper 13. This can be seen in FIG. 2 which shows the stack 3 in the intermediate position exactly at the instant of initial contact between the roller 24 and the topmost sheet of the stack, or shortly or immediately thereafter. The lower abutments 21 are preferably positioned in such a way that they are engaged by and temporarily depressed by the respective sidewalls 17 shortly before the peripheral surface of the roller 24 descends into actual air-expelling engagement or contact with the upper side of the topmost sheet below it. This reduces the likelihood of damage to the roller 24, to the advancing stack 3 and/or other parts of the improved apparatus and ensures gentle and smooth acceleration of the idler roller 24 as a result of frictional engagement with the topmost sheet of the stack beneath it.

It is preferred to provide the arrangement 1 with one or more abutments 31 in the form of horizontal platforms disposed beneath the lowermost sheet of the stack 3, the uppermost sheet of which is about to be contacted by the roller 24. The upper side of the illustrated abutment 31 is or can be flush with the upper side of the lower gripper 12 (see FIG. 2) to ensure that such upper side can serve as an optimally positioned rest for the lowermost sheet of the stack 3 whose uppermost sheet is being engaged and pressed downwardly by the roller 24 to squeeze entrapped air from between the sheets of the stack 3 as the latter continues to advance (in a direction to the right) beyond the position of FIG. 2.

FIG. 2 shows that the locus of initial engagement between the peripheral surface of the roller 24 and the upper side of the topmost stack 3 which assumes or is adjacent to the intermediate position is immediately adjacent to the rear end of the upper gripper 13. The pneumatic cylinders 19 bias the roller 24 downwardly into requisite firm air-expelling engagement with the sheet immediately below it while the sheet advances relative to and rotates the roller about the axis of the shaft 26.

As the carriage 8 continues to advance to the right beyond the position of FIG. 2, the guide 28 of the carriage moves away from the follower 29 which latter remains in the lower end position of FIG. 2 because the cylinders 19 continue to urge the roller 24 (by way of the conveyance) into firm air-expelling engagement with the advancing topmost sheet of the stack 3 which is on its way toward the second position shown in FIG. 3. Any air which has been entrapped between certain (or even all) neighboring sheets of the advancing stack 3 is reliably expelled by the roller 24 because the latter is maintained in requisite pressure-applying engagement with the advancing topmost sheet.

Once the carriage 8 reaches the end position of FIG. 3, or shortly thereafter, the cylinders 19 are caused to return the conveyance, the roller 24 and the follower 29 to the starting or upper end positions of FIG. 1. At such time, the stack 3 is already relieved of all previously entrapped air and the prime mover for the carriage 8 begins to move the carriage back toward the position of FIG. 1 subsequent to opening of the tongs including the grippers 12, 13 so that the freshly advanced stack 3 remains in the second position of FIG. 3 in which it can be engaged by a suitable conveyor or subjected to a packing, wrapping or other treatment not forming part of the present invention. The abutments 22 arrest the conveyance for the roller 24 in its upper end position of FIG. 1, and the conveyance thereupon remains in such raised position so that the carriage 8 is free to return all the way to the position of FIG. 1 in which the follower 29 is reengaged by the guide 28 and the apparatus is ready to proceed with the next advancing and air expelling operation. The grippers 12, 13 are spaced apart from each other not later than when the carriage 8 returns to the starting position of FIG. 1 so that the grippers can thereupon engage the front end portion of the freshly assembled or introduced stack 3 between the sidewalls 7 of the receptacle 6 by causing the gripper 13 to move downwardly toward the gripper 12 and/or by causing the gripper 12 to move upwardly toward the gripper 13. The stops 22 serve as yieldable dampers or shock absorbers for the respective sidewalls 17 of the conveyance, first when the conveyance is returned to the upper end position of FIG. 1, and again when the guide 28 reengages the follower 29 on or of the conveyance for the roller 24.

If a series of stacks having a height corresponding to that of the illustrated stack 3 is to be followed by a series of taller or thinner stacks, the level of the roller 24 relative to the sidewalls 17 of the conveyance is changed to ensure that, in its lower end position, the roller bears against the topmost sheet of the taller or thinner stack below it with the same force as against the stacks having a height corresponding to that of the illustrated stack 3, or with a larger or smaller force, depending upon the decision of the operator in charge of the improved air expelling apparatus. It is even possible to provide means for monitoring the final height of the stacks 3 which are being assembled in the receptacle 6 and to automatically change the level of the roller 24 relative to the sidewalls 17 in dependency on the changes of the height of successively monitored stacks. At any rate, the aforediscussed adjusting means including the end portions of the shaft 26 and the vertical slots 27 in the sidewalls 17 renders it possible to select the force which is being applied by the roller 24 during advancement of a stack 3 below it in order to reliably expel the entrapped air before or not later than when the thus treated or "deaerated" stack reaches the position corresponding to that of the stack 3 shown in FIG. 3. Such adjustability of the roller 24 relative to the sidewalls 17 renders it possible to expel air from taller or thinner stacks with the same degree of reliability, or to resort to the application of a greater or lesser force from the roller 24 to the advancing stack below it.

An important advantage of the feature that the second guides 14 make with the path for the stacks 3 an oblique angle is that the roller 24 can gradually descend into gentle force-transmitting or force-exerting engagement with the topmost sheet of an advancing stack 3 regardless of whether the stack is being advanced at a relatively low speed or at a relatively high speed.

An advantage of the guide 28 and of the associated follower 29 is that the location of initial contact between the roller 24 and the topmost sheet of any one of a long or short series of successive stacks is always the same. This not only eliminates the likelihood of collision between the upper gripper or grippers 13 and the descending roller 24 but also ensures that the expulsion of air from each of a long or short series of successive stacks is highly reliable because such expulsion begins very close to the front edge face of each of the stacks.

Though the air expelling device of the air expelling unit 16 can include or constitute one or more brushes, a rotary expelling device in the form of an idler roller 24 is preferred in many instances because it is highly unlikely to subject the topmost sheet or sheets of an advancing stack below it to any pronounced tensional stresses. This is due to the fact that the roller 24 begins to turn about the axis of its shaft 26 as soon as its peripheral surface is engaged by the topmost sheet of the advancing stack below it. The exact force with which the roller 24 bears upon the topmost sheet of an advancing stack 3 below it depends on the selected level of the roller 24 relative to the sidewalls 17 of the conveyance and/or upon the force with which the pneumatic motors including the cylinders 19 urge the conveyance and the roller 24 downwardly, i.e., toward the horizontal path for the advancing stacks 3.

An advantage of the motors including the cylinders 19 is that they occupy a surprisingly small amount of space and can be actually integrated into the conveyance which is to be reciprocated thereby.

A further advantage of the improved air expelling apparatus is its compactness, especially in directions transversely of the path for the stacks 3. This is particularly important if the illustrated apparatus is one of two or more apparatus each of which is adjacent to a discrete path for the advancement of a series of successive stacks from receptacles or other suitable sources toward one or more conveyors or toward discrete processing stations. Furthermore, the apparatus is simple, inexpensive, readily adjustable and more reliable and more versatile than heretofore known apparatus.

The second path (for the roller 24) can depart from a straight path. This can be readily achieved by appropriate selection of the configuration of the first guide 28 and the follower 29 and/or the second guides 14. All that counts is to ensure that the roller 24 can engage the topmost sheet of an advancing stack 3 immediately or at least closely behind the upper gripper 13 or an equivalent stack engaging and entraining member. The illustrated means for establishing a straight path for the movements of the conveyance and the roller of the unit 16 between their upper (retracted) and lower (extended or operative) end positions is preferred at this time because it is relatively simple and compact.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of expelling air from stacks of superimposed sheets and, therefore, such adaptations should and are intended to be comprehended within the meaning and range of equivalence of the appended claims.

What is claimed is:

1. Apparatus for expelling air which is entrapped between the sheets of stacks of sheets including a topmost sheet, comprising means defining a first predetermined path for the advancement of successive stacks of a series of stacks from a first position to a second position in such a way that a stack advancing along said first path has a front portion; means for advancing successive stacks of the series along said first path including means for engaging the front portions of the stacks in said first positions thereof; and means for expelling entrapped air from the advancing stacks, including at least one air expelling device movable downwardly into pressure-exerting engagement with the topmost sheet of a stack advancing along said first path, and means for confining said at least one device to downward movements along a predetermined second path, said means for confining including at least one guide provided on said advancing means.

2. The apparatus of claim 1, wherein said advancing means further comprises a carriage reciprocable along said first path and said means for engaging includes tongs provided on said carriage.

3. The apparatus of claim 2, wherein said at least one guide is provided on said carriage.

4. The apparatus of claim 1, wherein said means for expelling further comprises a conveyance for said at least one air expelling device, said conveyance being reciprocable with said at least one device along said second path and said confining means further including means for restricting said conveyance to movements along said second path, and at least one follower provided on said conveyance and arranged to track said at least one guide at least during downward movement of said at least one device toward pressure-exerting engagement with the topmost sheet of a stack advancing along said first path.

5. The apparatus of claim 4, wherein said first and second paths make an oblique angle.

6. The apparatus of claim 4, wherein said at least one guide and said restricting means are constructed and assembled to effect the engagement of said at least one device with the topmost sheet of a stack having a predetermined height, as measured transversely of said first path, in a predetermined intermediate position of such stack between said first and second positions.

7. The apparatus of claim 4, wherein said means for engaging includes tongs and said means for confining is operative to effect a start of pressure-exerting engagement of said at least one device with the topmost sheet of the stack advancing from said first position immediately adjacent and behind said tongs as seen in a direction of advancement of stacks from said first position.

8. The apparatus of claim 1, wherein said second path departs from a straight path.

9. The apparatus of claim 1, wherein said at least one guide defines a substantially vertical track and said means for expelling comprises a reciprocable conveyance for said at least one device, said conveyance being movable along said second path and said means for confining further comprising at least one follower provided on said conveyance and moving downwardly along said substantially vertical track during downward movement of said at least one device toward pressure-exerting engagement with the topmost sheet of a stack advancing from said first position thereof.

10. The apparatus of claim 9, wherein said at least one guide has a first substantially vertical surface which defines said track and said at least one follower has a second substantially vertical surface which engages said first surface during downward movement of said at least one device.

11. The apparatus of claim 1, wherein said at least one device comprises an idler roller.

12. The apparatus of claim 1, wherein said air expelling means further comprises a conveyance for said at least one device and for at least one follower forming part of said confining means and tracking said at least one guide during downward movements of said at least one device, said air expelling means further comprising means for repeatedly moving said conveyance along said second path first in a downward direction to move said at least one device into engagement with the topmost sheet of a stack leaving said first position, to thereupon maintain said at least one device in engagement with the topmost sheet of the stack continuing to advance from said first position toward said second position, and to thereupon raise the at least one device above and away from said first path.

13. The apparatus of claim 12, wherein said means for moving includes means for reciprocating said conveyance with said at least one follower and said at least one device along said second path downwardly toward and upwardly away from said first path.

14. The apparatus of claim 1, wherein said means defining said first path includes an abutment for a lowermost sheet of the stack advancing along said first path, at least while the topmost sheet of the advancing stack is being engaged by said at least one device.

15. The apparatus of claim 14, wherein said abutment includes a platform beneath said first path.

16. The apparatus of claim 1, wherein said means for expelling air further comprises a mobile conveyance for said at least one device and means for adjustably mounting said at least one device on said conveyance.

17. The apparatus of claim 16, wherein said means for adjustably mounting includes means for positioning said at least one device at any one of a plurality of different levels.

18. The apparatus of claim 17 for expelling air from stacks having different heights, wherein each of said levels is selected with a view to maintain said at least one device in predetermined pressure-exerting engagement with a stack having one of a plurality of different heights.

19. The apparatus of claim 1, wherein said means for expelling air further comprises a mobile conveyance for said at least one device and said means for confining further comprises at least one elongated second guide for restricting said conveyance to reciprocatory movements along said second path, said means for expelling air further comprising at least one fluid-operated motor for said conveyance.

20. The apparatus of claim 19, wherein said motor includes a pneumatic cylinder slidable along said at least one second guide and forming part of said conveyance.

* * * * *